US006397432B1

(12) United States Patent
di Vinadio

(10) Patent No.: US 6,397,432 B1
(45) Date of Patent: Jun. 4, 2002

(54) HINGE FOR AN OPENING DOOR OR WINDOW FRAME

(75) Inventor: Aimone Balbo di Vinadio, Milan (IT)

(73) Assignee: Savio S.p.A., Turin (IT)

( * ) Notice: Subject to any disclaimer, the term of this patent is extended or adjusted under 35 U.S.C. 154(b) by 0 days.

(21) Appl. No.: 09/592,579

(22) Filed: Jun. 12, 2000

(30) Foreign Application Priority Data

Jun. 16, 1999 (IT) ..... T099A0520

(51) Int. Cl.[7] ..... E05F 1/04
(52) U.S. Cl. ..... 16/242; 16/235; 16/241
(58) Field of Search ..... 16/242, 235, 239, 16/247, 241, 237, 238, 240

(56) References Cited

U.S. PATENT DOCUMENTS 4,494,275 A * 1/1985 Hsi-Shan ..... 16/314
5,781,966 A * 7/1998 Ferrari et al. ..... 16/242
5,964,012 A * 10/1999 Vigreux ..... 16/241
6,145,164 A * 11/2000 Ferrari et al. ..... 16/242

FOREIGN PATENT DOCUMENTS

| | | | |
|---|---|---|---|
| DE | 88 04 008 U | | 5/1988 |
| EP | 0 837 206 A | | 4/1998 |
| GB | 2253242 A | * | 9/1992 |
| WO | WO 98 41720 A | | 9/1998 |

* cited by examiner

*Primary Examiner*—Anthony Knight
*Assistant Examiner*—Mark Williams
(74) *Attorney, Agent, or Firm*—Sughrue Mion, PLLC

(57) ABSTRACT

Hinge for an opening door or window frame including a first and a second knuckle parts connected together by a pin, the arrangement being such as to allow adjustment between the first and second knuckle parts independently parallel to, and at right angles to, the general plane of the door or window. Adjustment parallel to the door or window is by means of a cam integral with the pin and engaged in the cavity of the first knuckle part. The cam and the cavity have surfaces of mutual contact formed in such a way that rotation of the causes a movement of relative translation only between the first and second knuckle parts.

7 Claims, 7 Drawing Sheets

HINGE FOR AN OPENING DOOR OR WINDOW FRAME

BACKGROUND OF THE INVENTION

The present invention relates to hinges for an opening door or window frame, of the type comprising one first and at least one second knuckle parts, each provided with a leaf for fixing it to the movable frame and to the fixed frame, respectively, of the door or window; a pin which connects the first and second knuckle parts together such that they can rotate; and first and second means of adjustment between the first and second knuckle parts parallel to and at right angles to, respectively, the general plane of the door or window.

Such hinges are currently used in a multitude of applications, including those with relatively heavy doors with frames consisting of metal sections. In this as in other similar applications, the process of adjusting the first and second knuckle parts of the hinges of the door or window, in other words between the movable frame and the fixed frame, must be able to be carried out with the greatest possible precision in order that when the door or window is closed, the movable frame of the door or window sits precisely in the fixed frame.

The particular purpose of adjustment in a direction at right angles to the general plane of the door or window is to adjust the compression of the seal with which one of the two frames is normally provided in order to achieve the ideal amount of compression and so ensure that external agents cannot enter.

The function of adjustment in a direction parallel to the general plane of the door or window, however, is to adjust the gap between the movable and fixed frames along their respective hinged uprights, in order to compensate for any structural imperfections or errors of assembly when the door or window is installed.

A fundamental requirement of the abovementioned means of adjustment is that as far as possible they should be able to be operated easily and quickly. These objectives are not fully achieved in currently known solutions, particularly as regards the adjustment of the gap between the movable and fixed frames.

Document EP-A-0,467,122 in the name of Dr Hahn GmbH provides for the use of two eccentric sleeves inserted one inside the other in the cavity of one of the two knuckle parts, by means of which sleeves it is possible, after making an adjustment in one of the two directions, to eliminate the error of adjustment thus introduced in the other direction.

This solution, besides requiring that the installer perform operations which are far from easy, has the effect of limiting the effects of the adjustment of the door or window gap because the amount of adjustment possible in the plane parallel to the general plane of the door or window is small, or at any rate of fixed size.

A much more efficient solution from this point of view has been proposed by the applicant in its own Italian utility model application No. T097U000055, corresponding to international patent application No. WO 84/41720, according to which the first and second means of adjustment are independent of each other, the first being functionally connected to the abovementioned first knuckle part and the second to the abovementioned second knuckle part of the hinge. The first means of adjustment according to this known solution involve an arrangement such that the pin is inserted loosely into a cavity of elongate section in the first knuckle part and can be moved in a diametrical direction within this cavity by means of one or more, advantageously a pair of, opposing set screws, either of which, or both simultaneously, can be adjusted with an external driving tool.

Though much more practical and functional than the solution mentioned previously as regards the ease and speed with which the adjustment can be performed, this solution is nonetheless relatively costly.

From EP-A-0837206 a hinge for swingingly supporting a door leaf from a door frame is known, wherein the first means of adjustment include a cam integral with the pin of the hinge and engaged rotatably inside a cavity in the abovementioned first knuckle part. The cam is formed by an eccentric section of the pin bearing a retainer resilient member having an indented edge designed to cooperate with corresponding indentations provided in the inner wall of the cavity of the first knuckle part.

By this arrangement adjustment is carried out in a stepwise and thus not in a continuous manner, and moreover stability of the adjusted position in the installed condition may be jeopardized owing to any plays or yelding or breakage of the retainer resilient member.

SUMMARY OF THE INVENTION

The object of the present invention is to provide a hinge for an opening door or window frame of the type defined above, configured in such a way as to ensure the greatest possible simplicity, efficiency and speed of adjustment of the movable frame with respect to the fixed frame, which hinge must be satisfactorily simple and inexpensive to produce and, especially as regards adjustment in a direction parallel to the general plane of the door or window, such as to ensure the greatest possible stability when installed.

One particular object of the invention is to provide a hinge for an opening door or window frame of the type defined above that will enable simple adjustment in a direction parallel to the general plane of the door or window directly on site, and without undesirable effects of any kind on the adjustment at right angles to the general plane of the door or window which can generally be carried out at a preliminary stage prior to the fitting to the door or window.

According to the invention this object is achieved by virtue of the features set forth in claim 1.

Additional advantageous features of the invention are defined in claims 2–8.

BRIEF DESCRIPTION OF THE DRAWINGS

The invention will now be described in detail with reference to the accompanying drawings, which are provided purely by way of non-restrictive example and in which.

DETAILED DESCRIPTION OF THE INVENTION

Figure 1:
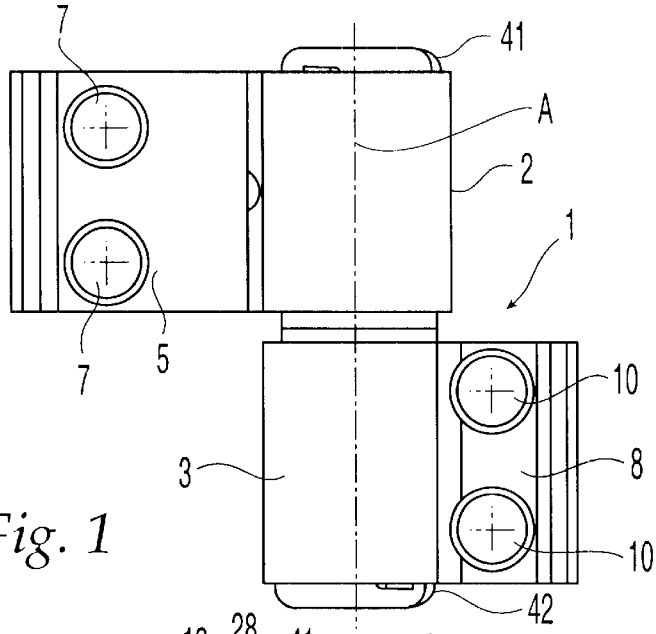
FIG. 1 is a schematic front view of a hinge for an opening door or window frame according to the invention.
Figure 2:
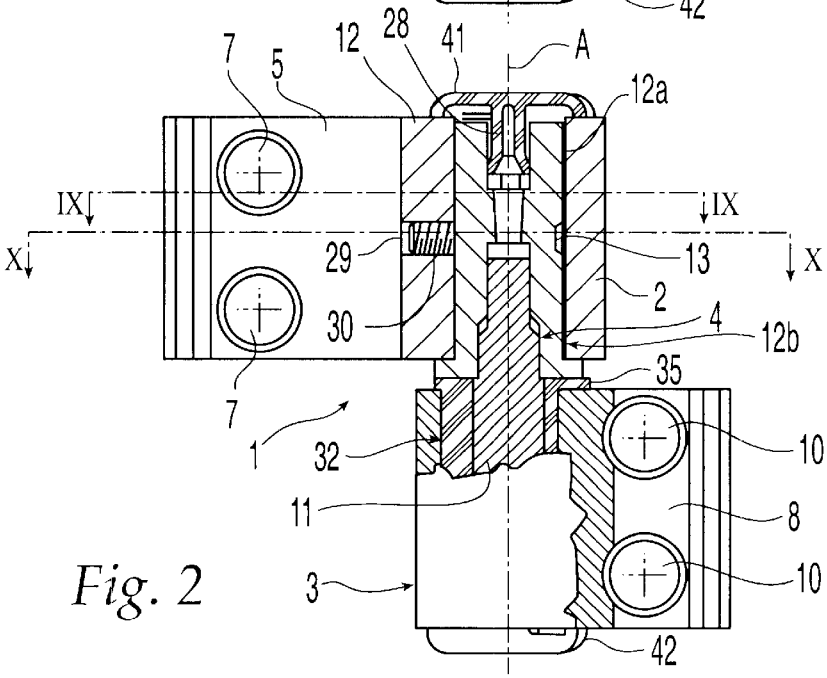
FIG. 2 is a plan view of FIG. 1.
Figure 3:
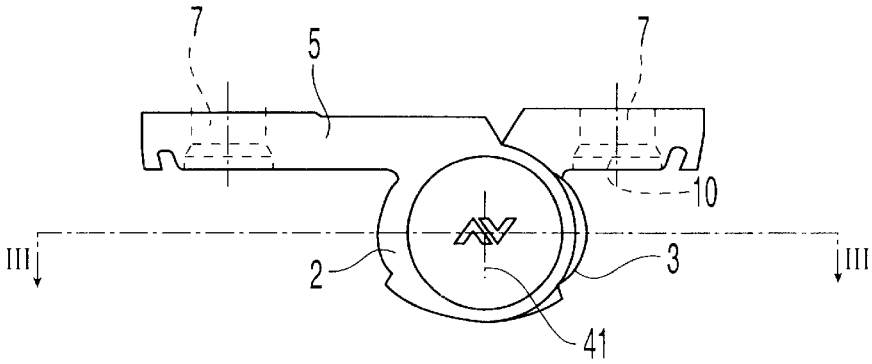
FIG. 3 is a vertical section taken on III—III as marked in FIG. 2.
Figure 4:
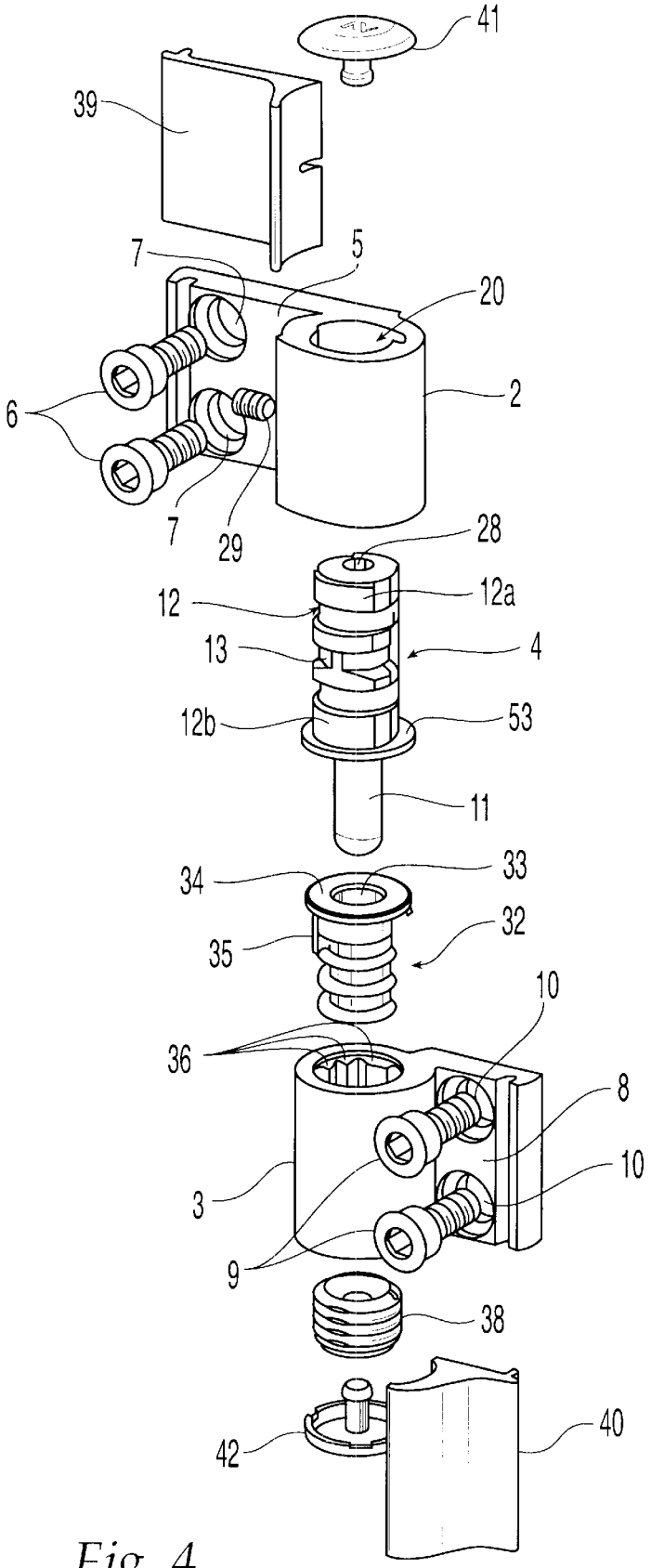
FIG. 4 is an exploded perspective view of the hinge.
Figure 5:
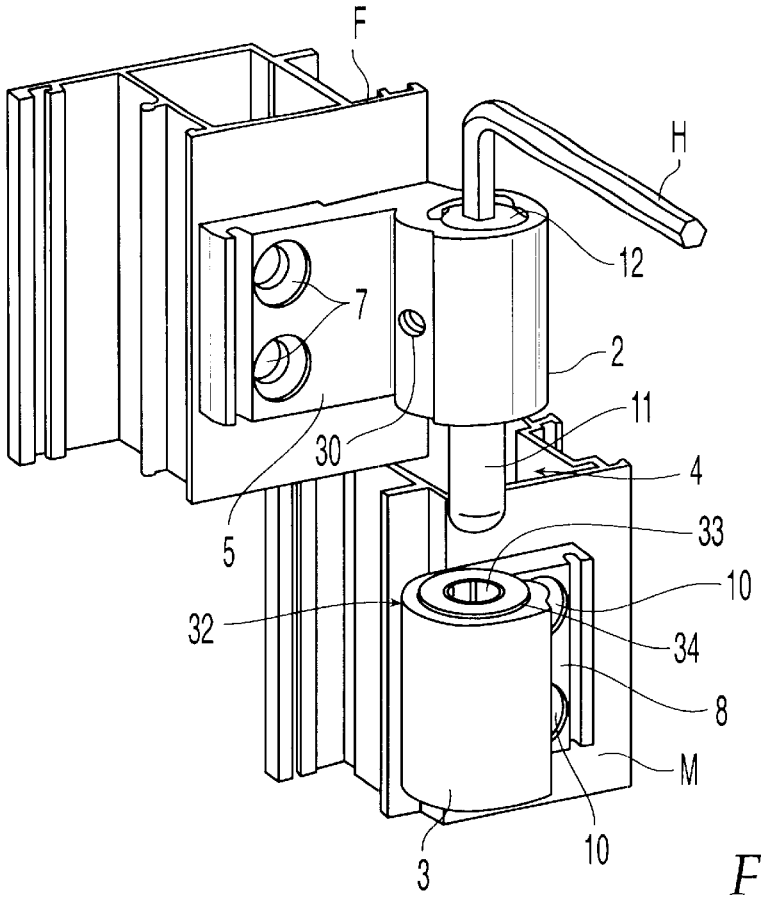
FIG. 5 is a partly exploded perspective view showing an example of how the gap in a door or window frame equipped with the hinge according to FIGS. 1 to 4 is adjusted.

Referring initially to FIGS. 1 to 4, reference 1 is a general indication for a hinge according to the invention for opening door or window frames, particularly but not exclusively for heavy doors. It essentially comprises a first knuckle part 2 and a second knuckle part 3 arranged axially one above the other and connected rotatably by a pin having the general reference 4.

The first knuckle part 2 is produced in one part with a leaf 5 to enable it to be fastened, with screws 6 inserted through holes 7, to an upright of a movable frame F (FIGS. 5–8) of the door or window. Similarly the second knuckle part 3 is made in one piece with a leaf 8 so that it can be fastened, with screws 9 inserted through holes 10, to a corresponding upright of the fixed frame M (FIGS. 5–8) of the door or window.

The pin 4 has a lower part 11 which rotates, as explained later, in the second knuckle part 3. The upper part of the pin 4 consists, according to the invention, of a cam indicated generally by the number 12 and normally formed by a hollow body separate from the pin 4 and rigidly connected to the top of the lower part 11 of the pin 4, e.g. by driving or equivalent systems.

The cam 12 is formed by two active profiles, namely an upper profile 12*a* and a lower profile 12*b*, separated by an intermediate grooved part 13. Below the active part 12*b* is an annular flange 53 external to the knuckle part 2.

Each of the two active parts 12*a*, 12*b* of the cam 12 has a particular and characteristic configuration illustrated in greater detail in FIGS. 9 and 10–12. This configuration, which is identical for both active profiles 12*a*, 12*b*, includes a first angular portion 14 and a second angular portion 15. These are on opposite sides of the axis of the pin 4 marked A, with which they are concentric, and both are of constant radius, a shorter radius in the case of the first angular portion 14 and a longer radius in the case of the second angular portion 15.

The first and second angular portions 14, 15 are connected by third and fourth angular portions 16, 17 of variable radius. Between the first angular portion 14 and the third angular portion 16 on the one hand, and the fourth angular portion 17 on the other, are two recesses 18, 19.

Figure 10:
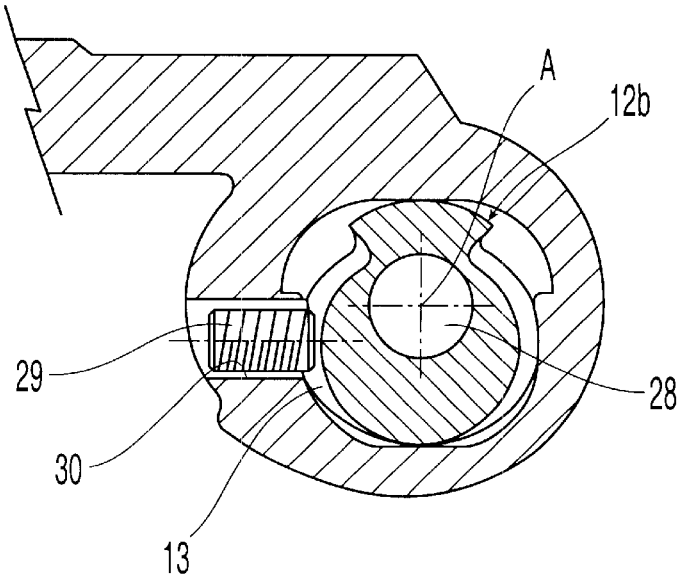
FIG. 10 is a view in horizontal section and on a larger scale taken on X—X as marked in FIG. 3 in the adjustment condition shown in FIG. 9, FIGS. 11 and 12 are two views similar to FIG. 9 in the adjustment conditions corresponding to FIG. 7 and FIG. 8, respectively.

As can be seen in FIG. 10, the profile of the intermediate grooved part 13 of the cam 12 is similar to that of the third and fourth angular portions 16, 17 of the active profiles 12*a*, 12*b*.

The cavity of the first knuckle part 2 into which the cam 12 is inserted also has a special and characteristic configuration, in such a way that it is functionally complementary to the configuration described earlier for the active profiles 12*a*, 12*b* of the cam 12. In particular, and still referring to FIG. 9, this cavity, which has the general reference 20, possesses more or less flat first and second angular section 21, 22 situated on opposite sides of the axis A of the pin 4 and separated from each other by a distance approximately equal to (in practice slightly greater than) the distance between the first and second angular portions 14, 15 of each active part 12*a*, 12*b* of the cam 12. The edges of the first section 21 join up with the two angular sections 22', 23 whose constant radius is approximately equal to (in practice slightly greater than) that of the first angular portion 14 of the active parts 12*a*, 12*b* of the cam 12. The second section 22 joins up with two angular sections 24, 25 whose variable radius is slightly greater than the variable radius of the second and third angular portions 16, 17 of the active parts 12*a*, 12*b* of the cam 12. Between the angular sections of constant radius 22', 23 and the angular sections of variable radius 24, 25 are two inward projections 26, 27 complementary with the recesses 18, 19.

It should be noted that, with the special configuration illustrated in the drawings and described above, between each active part 12*a*, 12*b* of the cam 12 of the pin 4 and the cavity 20 of the first knuckle part 2 there are always, in any relative angular position, at least two and more conveniently four axial areas of mutual direct pressure or reaction contact arranged in pairs on diametrically opposite sides of the pin 4. The pair of areas B, C is contained in a diametrical plane at right angles to the general plane of the door or window, and the pair of areas D, E is contained in a diametrical plane parallel to the general plane of the door or window. This arrangement ensures efficient guiding and no looseness between the cam 12 and the knuckle part 2 regardless of how the device is adjusted.

In order to modify the relative angular position between the cam 12 and the cavity 20, this cam 12 is formed with a central hole 28 coaxial with the axis A of the pin 4, its shape being conveniently hexagonal to take a hexagonal driving key of the hexagon socket wrench type, marked H is FIGS. 5 to 8.

Shown at 29 is a set screw, also conveniently with a hexagonal slot, screwed into a threaded hole 30 in the side of the first knuckle part 2. The inner end of the screw 29 engages with the intermediate grooved part 13 of the cam 12 to prevent it, and therefore the pin 4, from rotating relative to the first knuckle part 2. Thus there is no need of providing an auxiliary resilient positioning member which might negatively affect stability of the adjusted position in the installed condition owing for instance to any plays or yelding thereof.

With the arrangement described above, the hexagon socket wrench H can be used to carry out an adjustment of the first knuckle part 2 relative to the second knuckle part 3 in a direction parallel to the plane of the door or window—in other words to adjust the gap L between the upright of the fixed frame M and the corresponding upright of the movable frame F. The invention makes it possible to adjust this gap L independently from the other possible adjustment, which is the adjustment in a direction perpendicular to the general plane of the door or window, and without in any way influencing the latter adjustment. This is a direct consequence of the fact that, because of the configuration described above, adjustment of the gap L occurs by virtue of a movement of translation only of the movable frame F relative to the fixed frame M in a direction parallel to the general plane of the door or window.

Figure 6:
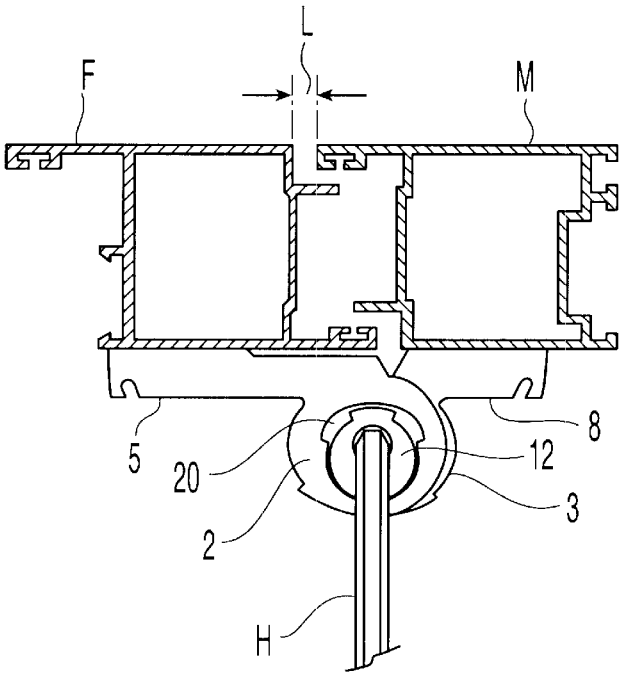
FIGS. 6, 7 and 8 show three top-down plan views of FIG. 1 in three different possible situations of adjustment of the frame gap.
Figure 7:
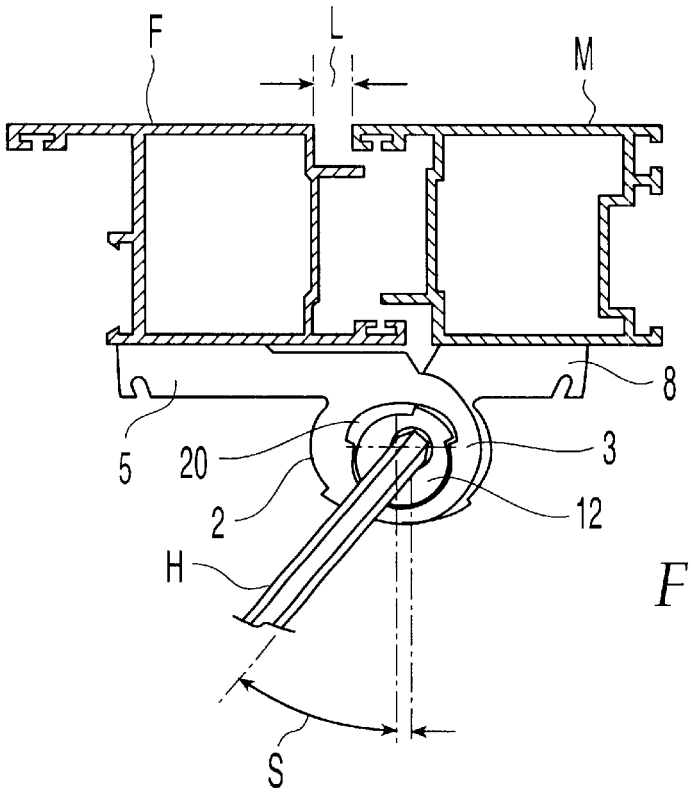
Figure 8:
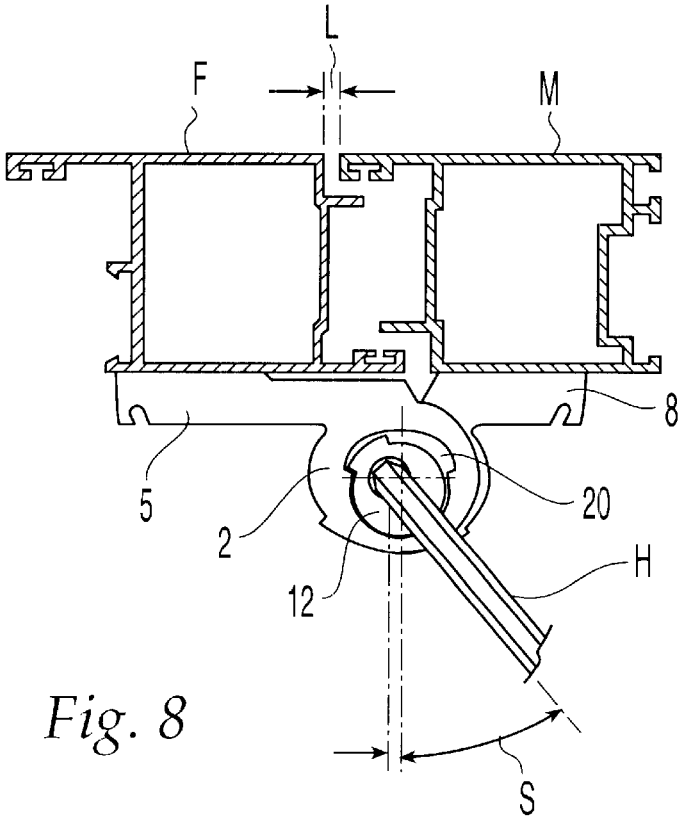
Figure 9:
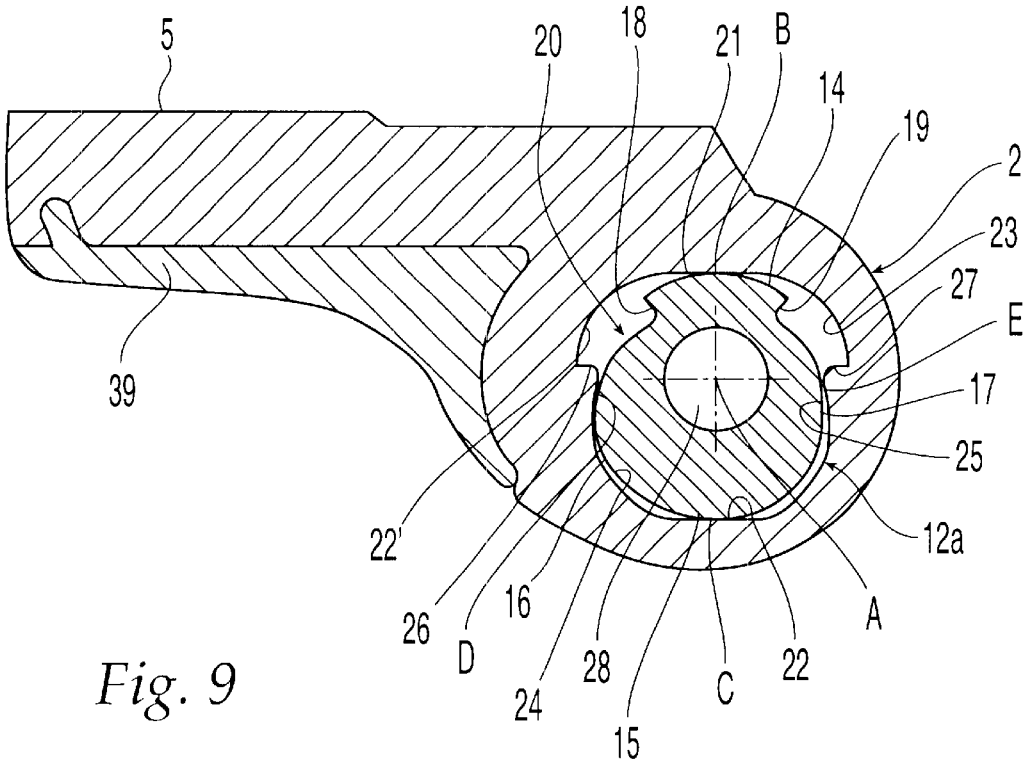
FIG. 9 is a view in horizontal section and on a larger scale taken on IX—IX as marked in FIG. 3, corresponding to the adjustment situation shown in FIG. 6.

FIGS. 6 and 9 show a neutral condition of intermediate adjustment between two extreme conditions illustrated in FIGS. 7, 11 and 8, 12 respectively. In this intermediate condition, which corresponds to a gap in which L is e.g. of the order of 5 mm, the hexagon socket wrench H is at right angles to the general plane of the door or window: in this condition the cam 12 is central with respect to the cavity 20, with the contact areas B and C corresponding to the centre line of the flat sections 21 and 22, respectively, and the contact areas D and E situated near the stop projections 26 and 27, respectively.

Figure 11:
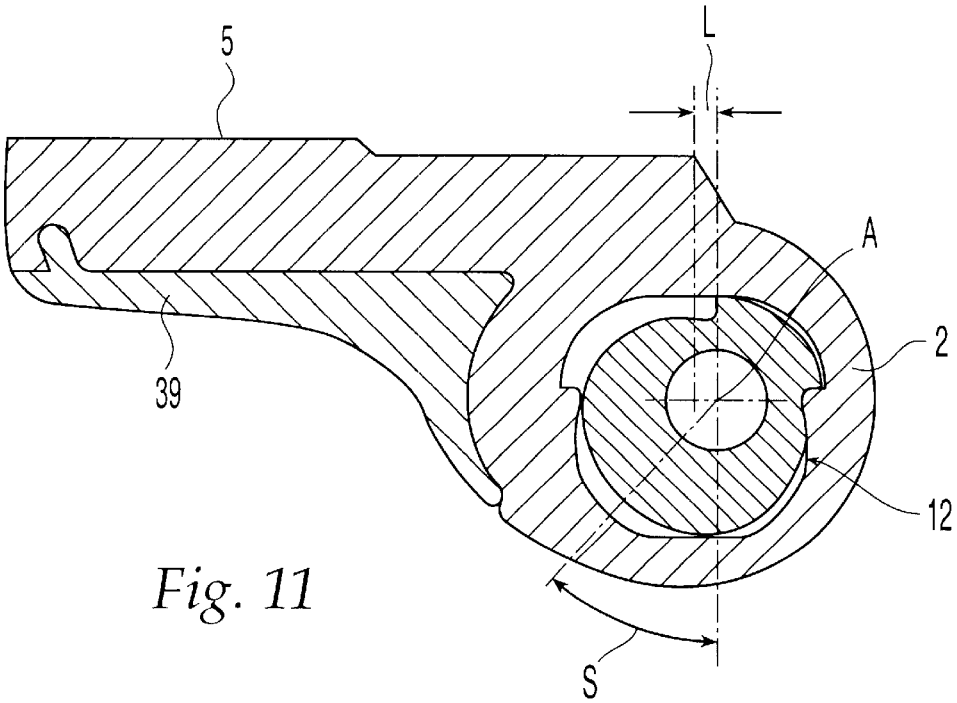

Turning the socket wrench H clockwise gives the extreme position shown in FIGS. 7 and 11, which corresponds to the largest possible gap L e.g. of the order of 7 mm. The affect of this rotation, occupying an angle S of e.g. approximately 40°, is that the recess 19 is brought up against the stop projection 27. The contact areas B, C and D, E are maintained throughout the rotation as far as the extreme position described above.

Figure 12:
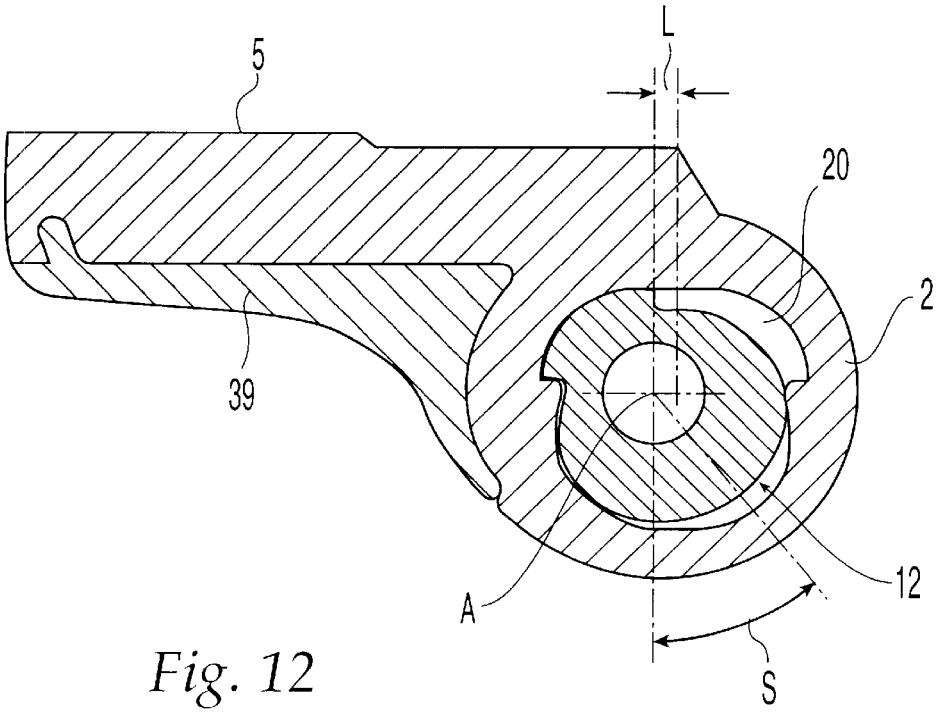

Turning the socket wrench H anticlockwise through the same angle S, however, results in the extreme position shown in FIGS. 8 and 12, in which the recess 18 meets the stop projection 26. This reduces the gap L to about 3 mm, and the contact points B, C and D, E are again maintained throughout the rotation.

The socket wrench H, which advantageously also serves as a pointer giving an immediate visual check of the degree of adjustment, may of course be stopped in any intermediate position between the two extreme positions described above, according to need: the range of adjustment is therefore conveniently variable in a continuous manner between±2 mm from the central position shown in FIGS. 6 and 9.

Once the door or window is in the desired position the pin 4 is locked, as indicated, to be prevented from rotating relative to the first knuckle part 2, by screwing in the set screw 29 in the manner illustrated in FIG. 10 with reference to the central position shown in FIG. 9.

Adjustments between the first knuckle part 2 and the second knuckle part 3 in a direction perpendicular to the general plane of the door or window, in other words adjustment of the pressure between the movable frame F and the fixed frame M, is done in a manner known per se (described in the aforementioned Italian utility model application No. TO97U000055) by means of a sleeve 32 inserted in the cavity of the second knuckle part 3.

This sleeve 32, which is normally made of a self-lubricating plastic with a low coefficient of friction, contains an eccentric cylindrical cavity 33 in which the lower part 11 of the pin 4 is inserted and can rotate. The eccentricity of the cavity 33 with respect to the peripheral surface of the sleeve 32 may be for example of the order of 1 mm.

The sleeve 32 has at its upper end an annular flange 34 that sits on the upper edge of the second knuckle part 3, and externally one or more axial key-like projections 35 (of which there are advantageously three) designed to engage in a series of internal longitudinal splines 36 in the knuckle part 3.

During assembly the keys 35 are inserted into those splines 36 to which the desired degree of pressure between movable frame F and fixed frame M corresponds. Clearly, this setting, which is normally effected by the door or window manufacturer, can be modified by the installer by placing the keys 35 of the sleeve 32 in the most suitable angular position.

The hinge 1 is completed by a threaded part 38 engaged in a tapped hole in the lower end of the second knuckle part 3 in order to vary the vertical position of the sleeve 32, and therefore the height of the pin 4.

Covers 39, 40 are fixed to the leaves 5 and 8 of knuckle 2, 3 to cover their respective fastening screws 6 and 9, and protective caps 41, 42 are fitted removably to the top of the first knuckle element 2 and to the base of the second knuckle element 3, respectively.

Figure 13:
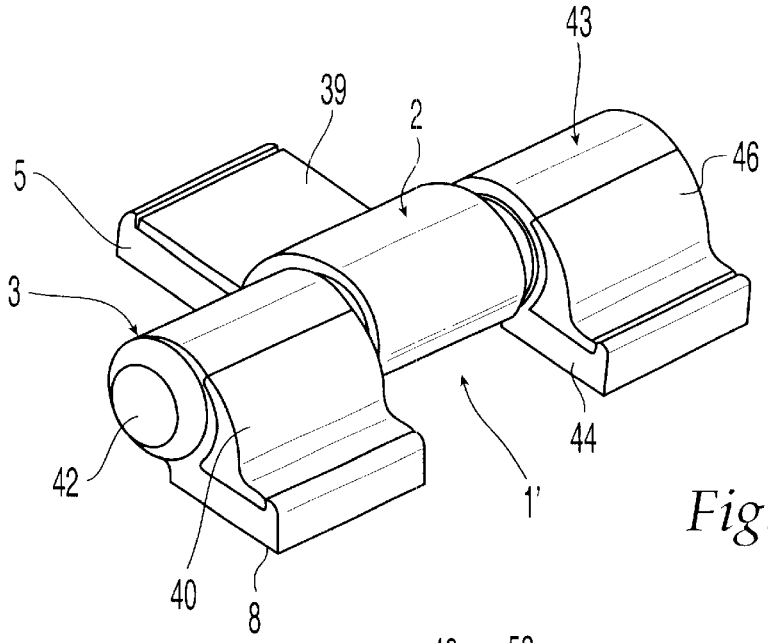
FIG. 13 is a perspective view of a variant of the hinge.
Figure 14:
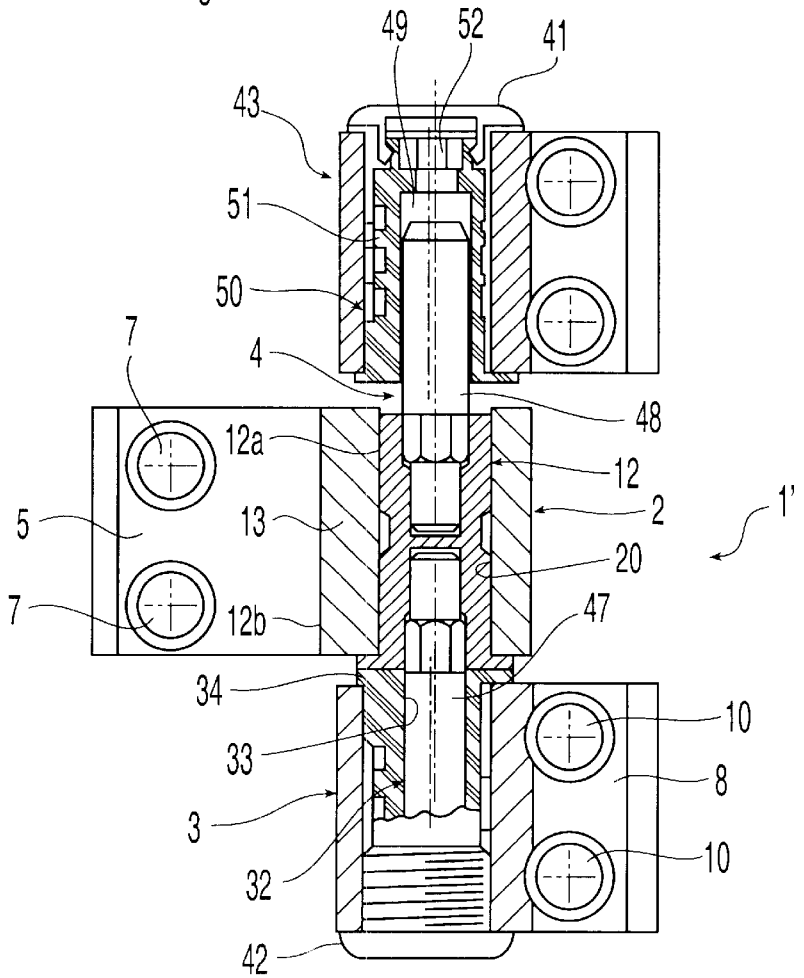
FIG. 14 is a view in longitudinal section through the hinge shown in FIG. 13.

The invention is also applicable to hinges having not one but two knuckle parts that f fix to the fixed frame M of the door or window. A variant of this kind is shown in FIGS. 13 and 14, in which parts identical or similar to those already described earlier are given the same numerical references. In this variant the hinge, indicated as a whole by the number 1', includes another second knuckle part 43 with an integral leaf 44 for fixing, by means of holes 45, to 30 the fixed frame M of the door or window, and an associated cover 46. Here the pin of the hinge 1' is divided in two and includes a lower pin portion 47 engaged rotatably inside the sleeve 32 and an upper pin portion 48 engaged rotatably inside the eccentric cavity 49 of a sleeve 50 similar to the sleeve 32, but upside down compared to the latter, and inserted adjustably—in exactly the same way as the sleeve 32—in the cavity 51 of the knuckle part 43.

The two pin portions 47 and 48 are connected rigidly to the cam 12 which sits inside the cavity 20 of the first knuckle part 2: the shape of the cam 12 and that of the cavity 20 are exactly as described earlier, and once again the cam 12 can be prevented from rotating relative to the knuckle part 2 by means of a set screw (not visible in FIGS. 13 and 14) identical to the set screw 23.

For the rotation of the cam 12 relative to the knuckle part 2, the upper end of the pin part 48 is formed with a hexagonal axial hole, similar to hole 28, in order to accept the hexagon socket wrench H through a passage 52 through the bush 50, after removal of the cap 41.

Here again the rotation of the cam 12 produces a movement of translation only of the knuckle parts 3 and 46 relative to the knuckle part 2, and hence of the movable frame F relative to the fixed frame M, parallel to the general plane of the door or window. The adjusting of the gap between movable and fixed frames is therefore, with this embodiment also, completely independent of, and without influence on, the adjustment of the pressure between the movable and fixed frames in a direction perpendicular to the general plane of the door or window, as carried out by moving the sleeves 32 and 50.

Clearly, the details of construction and the embodiment can be greatly varied with respect to those described and illustrated without thereby departing from the scope of the present invention as defined in the following claims.

What is claimed is:

1. A hinge for a door or window having a general plane and comprising a movable frame and a fixed frame, said hinge including one first and at least one second knuckle parts, each provided with a respective leaf for fixing it to said movable frame and to said fixed frame respectively, of the door or window, a pin which connects the said first and second knuckle parts together such that they can rotate, and first and second means of adjustment between the said first and second knuckle parts parallel to and at right angles to, respectively, said general plane of the door or window, wherein the said first and second means of adjustment are independent of each other and the former are functionally connected to the said first knuckle part and the latter to the said second knuckle part of the hinge, the improvement wherein:

said first means of adjustment include a cam 20 integral with said pin and engaged rotatably inside the cavity of the said first knuckle part, the said cam and the said cavity having surfaces of mutual contact formed in such a way that rotation of the cam causes a movement of relative translation only between the said first and second knuckle parts, and therefore of the said movable frame relative to the said fixed frame, in the said direction parallel to said general plane of the door or window, retention means are provided to make the said cam fixed in rotation with the said first knuckle part, there exist between the said cam and the cavity of the said first knuckle part, regardless of their relative angular position, at least two axial areas of mutual direct pressure contact located diametrically opposite each other relative to the said pin, wherein the said cam comprises:

first and second angular portions of constant radius on opposite sides of the axis of the pin, with which they are concentric, the first angular portion having a shorter radius and the second angular portion having a longer radius, and third and fourth angular portions of variable radius that connect the said first and second angular portions on opposite sides thereof, and wherein the said cavity comprises:

substantially flat first and second angular sections situated on opposite sides of the axis of said pin and separated from each other by a distance approximately equal to the distance between the said first and second angular portions of said cam, said first flat section being joined up with two angular sections whose constant radius is approximately equal to that of the said first angular portion of the said cam, and the said second flat section being joined up with two angular sections whose variable radius is slightly greater than the variable radius of the said second and third angular portions of the said cam.

2. Hinge according to claim 1, including four of the said areas of mutual pressure contact arranged in two diametrical directions oriented one at right angles to, and the other parallel to, said general plane of the door or window.

3. Hinge according to claim 1, wherein between the said angular sections of constant radius and the said angular sections of variable radius of the said cavity two stops are provided which are designed to engage with the first angular portion of the cam in order to limit its rotation with respect to the cavity in either direction from a neutral central position.

4. Hinge according to claim 1, wherein the said retention means comprise a threaded part screwed into a lateral capped hole of the said first knuckle part in order to engage with a grooved part of the said cam.

5. Hinge according to claim 4, wherein the said grooved part has a profile corresponding to that of the said third and of the said fourth angular portions of variable radius of the said cam.

6. Hinge according to claim 1, wherein the said cam has an axial end seat accessible from the exterior for the engagement of a drive tool.

7. Hinge according to claim 1, wherein the said second means of adjustment between the said first and second knuckle parts include a sleeve inserted in the said second knuckle part and having an eccentric cylindrical cavity in which the said pin is inserted, the said sleeve and the said knuckle part having means of mutual keying to enable a firm orientation of the sleeve in a plurality of different relative angular positions.

* * * * *